United States Patent [19]

Krynski

[11] Patent Number: 4,460,175

[45] **Date of Patent: * Jul. 17, 1984**

[54] DROP TARGET ASSEMBLY FOR PINBALL GAME

[75] Inventor: Edward P. Krynski, Downers Grove, Ill.

[73] Assignee: Mylstar Electronics, Inc., Northlake, Ill.

[ * ] Notice: The portion of the term of this patent subsequent to Sep. 9, 1997 has been disclaimed.

[21] Appl. No.: 331,681

[22] Filed: Dec. 17, 1981

Related U.S. Application Data

[63] Continuation of Ser. No. 134,258, Mar. 26, 1980, abandoned, which is a continuation of Ser. No. 26,854, Mar. 15, 1979, Pat. No. 4,221,384.

[51] Int. Cl.[3] ..... A63D 3/02

[52] U.S. Cl. ..... 273/127 R; 200/61.11; 273/121 A

[58] Field of Search ..... 273/121 A, 127 R, 127 C, 273/181 J, 123 A, 118 A, 118 D, 119 A, 120 A; 200/61.11

[56] References Cited

U.S. PATENT DOCUMENTS

| | | | |
|---|---|---|---|
| 180,226 | 7/1876 | Piper et al. . | |
| 240,334 | 4/1881 | Pittman . | |
| 294,590 | 3/1884 | Crandall . | |
| 343,088 | 6/1886 | Stiker . | |
| 923,830 | 6/1909 | Grounds . | |
| 1,325,921 | 12/1919 | Amlie . | |
| 1,534,522 | 4/1925 | Halliday . | |
| 1,949,488 | 3/1934 | Rockola . | |
| 2,095,513 | 10/1937 | Reznick . | |
| 2,830,819 | 4/1958 | Pearl | 273/121 |
| 3,078,096 | 2/1963 | Wisner . | |
| 3,927,884 | 12/1975 | Glass et al. | 273/119 R |
| 4,037,842 | 7/1977 | Breslow | 273/127 R |
| 4,190,252 | 2/1980 | Kindig | 273/127 R |
| 4,221,384 | 9/1980 | Krynski | 273/118 D |
| 4,249,736 | 2/1981 | Rosenthall | 273/127 R |

FOREIGN PATENT DOCUMENTS

| | | |
|---|---|---|
| 2351353 | 4/1974 | Fed. Rep. of Germany . |
| 2812173 | 5/1978 | Fed. Rep. of Germany . |
| 1418509 | 12/1975 | United Kingdom . |

OTHER PUBLICATIONS

Play Meter, pp. 108, 109, Nov. 1978.
Cash Box, pp. 72, 74, Oct. 28, 1978.
Automaten Markt, 32/XII, Dec. 1978.

*Primary Examiner*—Robert L. Lindsay, Jr.
*Attorney, Agent, or Firm*—Arnold, White & Durkee

[57] ABSTRACT

A drop target assembly for a pinball game having a series of vertical sliders each having a target at its upper end and movable between an upwardly projecting play position and a drop position, each slider having a latch for latching the same in play position. A reset device is provided on the frame for thrusting all of the sliders upwardly to set the latches with all of the targets in play position, so that when one of targets is subsequently hit by the ball rearwardly during the course of play, the latch is released resulting in dropping of the target. Each of the sliders has an associated electromagnet including a movable armature adjacent the latch and coupled to the upper end of the slider to release the latch. A remote ball-operated device on the play field has a switch which is connected by circuitry to at least one of the electromagnets so that when the remote device is actuated the electromagnet is energized for artificially dropping the associated target. In the preferred form of the invention duplicate target assemblies are mounted remotely from one another on the play field, with each target having an associated switch and an associated electromagnet and with each switch being connected to a corresponding electromagnet in the other assembly so that the hitting of a target in one assembly causes corresponding targets to drop in both of the assemblies.

21 Claims, 7 Drawing Figures

FIG. 4
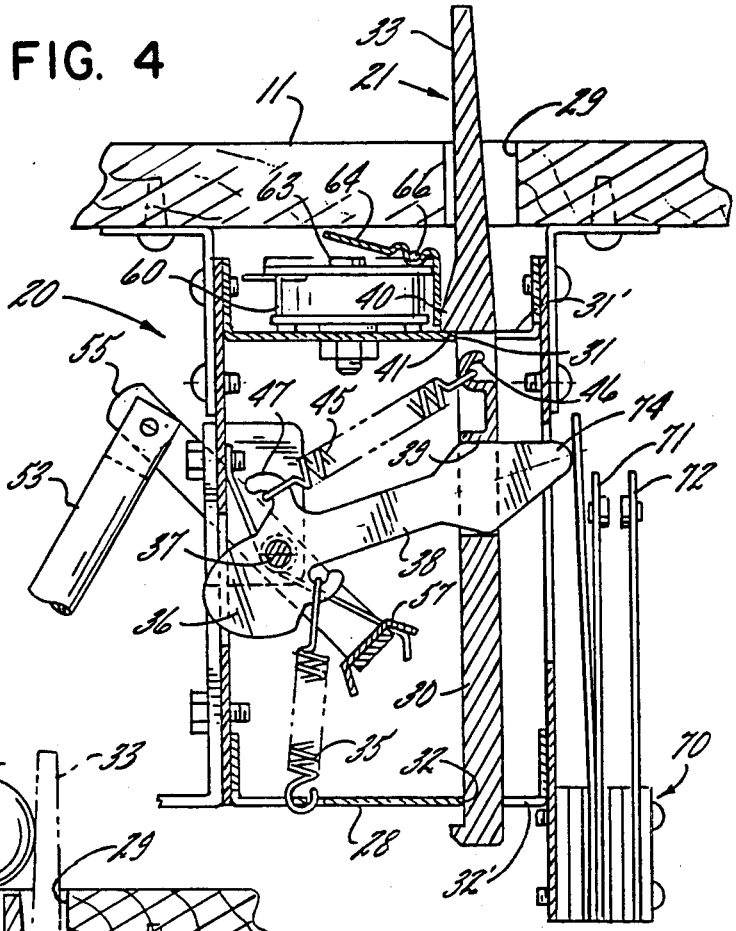
FIG. 5
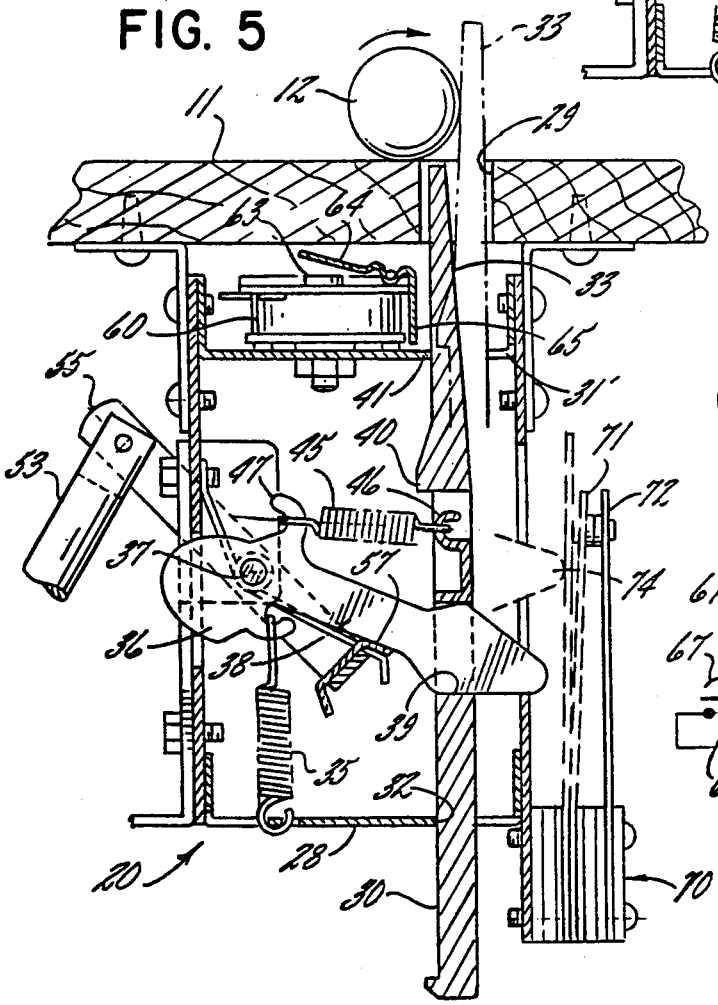
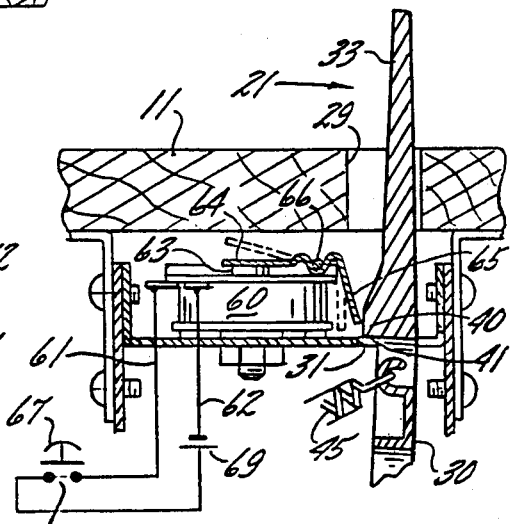
FIG. 6

DROP TARGET ASSEMBLY FOR PINBALL GAME

This is a continuation of application, Ser. No. 134,258, filed Mar. 26, 1980 abandoned which is a continuation of Ser. No. 26,854 filed Mar. 15, 1979 now U.S. Pat. No. 4,221,384 granted Sept. 9, 1980.

The increasing popularity of pinball games is due largely to the thought and ingenuity of the designers in incorporating features to make the games more interesting and exciting in play. A feature which has received increasing acceptance is a so-called drop target, a target which normally projects above the level of the play field but which when hit by a ball projected by a flipper responds by dropping into a recessed position.

It is an object of the present invention to provide in a pinball game, a drop target assembly having a set of targets which are not only releasable upon being hit by a ball but which have provision for artificial release by a remote ball-actuated device on the play field. It is a related object to provide a drop target assembly having targets which are dropped upon the making of a direct hit resulting in a score or dropped, in absence of a direct hit, when the ball hits an associated remote device on the play field thereby to achieve double scoring for the purpose of making the and to speed up the pace of the game. It is a more specific object of the present invention to provide a drop target assembly in which an electromagnet is associated with each of the targets to bring about two modes of dropping the first by the making of a direct hit and the second by pulsing of the electromagnet as the result of hitting a remote device on the playfield.

It is a still more specific object of the invention to provide on the play field of a pin ball machine duplicate drop target assemblies in which each target has an electromagnet for artificially actuating the same plus a switch responsive to dropping of the target, with a switch on the target in one of the assemblies being coupled to the electromagnet of a corresponding target in the other assembly so that each time a single target is directly hit two targets fall on a symmetrical basis.

Other features and advantages of the invention will become apparent upon reading the attached detailed description and upon reference to the drawings in which:

FIG. 4 is a typical cross section taken along line 4—4 in FIG. 2 showing a drop target in play position.

FIG. 5 is a cross sectional view corresponding to FIG. 4 but showing the slider in recessed position following the making of a direct hit.

FIG. 6 is a fragmentary section showing the operation of the electromagnet to release the latch to bring about an artificial drop.

While the invention has been described in connection with a preferred embodiment, it will be understood that I do not intend to be limited to the particular embodiment shown but intend, on the contrary, to cover the various alternative and equivalent forms of the invention included within the spirit and scope of the appended claims.

Figure 1:
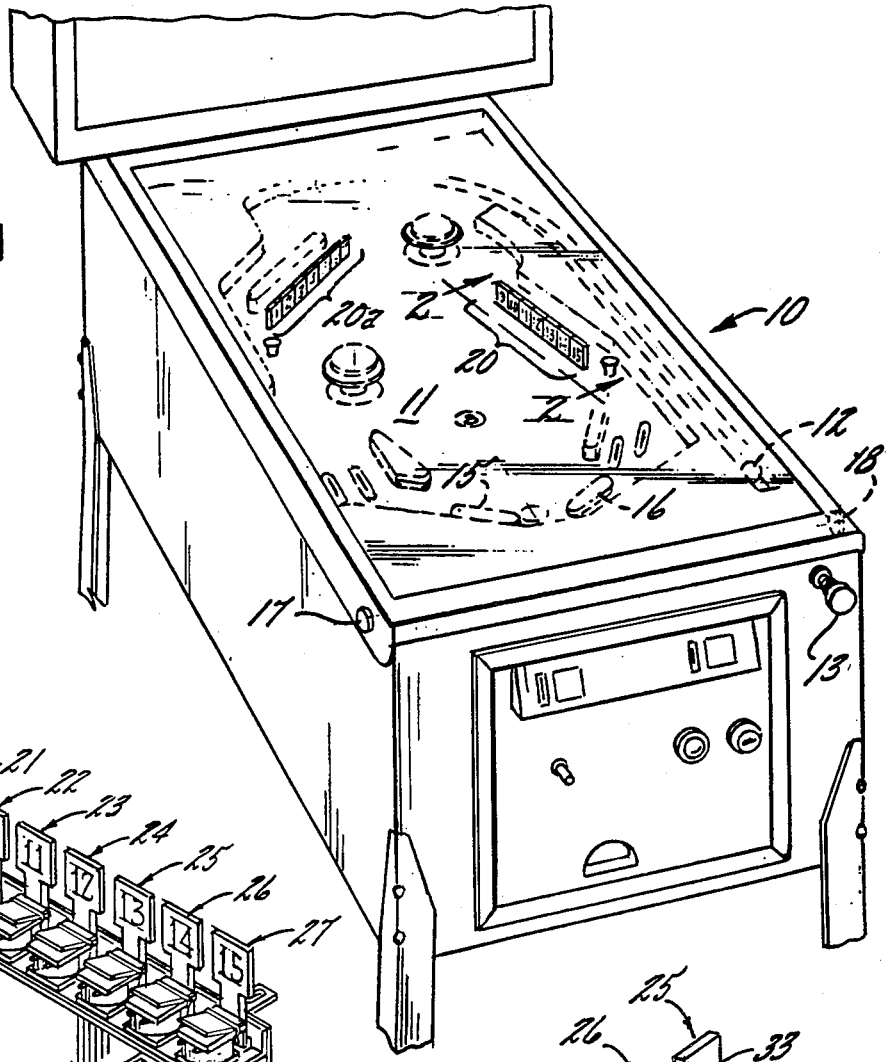
FIG. 1 is a perspective view of a pinball machine having a play field which includes the present invention.

Turning now to the drawings there is disclosed in FIG. 1 a typical pinball machine 10 having a play field 11 in which a ball 12 is put in play by means of a spring plunger 13. The ball is kept in play by means of manually operated flippers 15, 16 operated by respective buttons 17, 18 positioned along the sides of the machine.

In accordance with the present invention the play field includes a drop target assembly, indicated at 20, and which is shown in detail in the subsequent figures. Briefly stated the drop target assembly includes a series of targets which drop from an exposed play position to a recessed position upon receiving a direct hit by the ball as the ball is propelled by one of the flippers. The assembly also includes provision, in the form of an electromagnet, for artificially dropping a target even though not struck by the ball when a remote ball-operated device on the play field is actuated. Such remote device may, for example, be in the form of a duplicate drop target assembly 20*a*.

Figure 2:
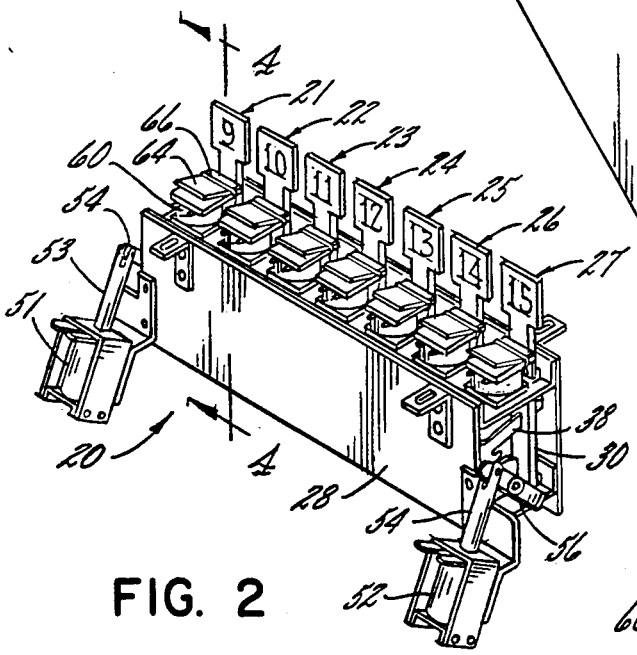
FIG. 2 is a perspective view of a drop target assembly employed in the machine of FIG. 1 as viewed along line 2—2 in that figure.
Figure 3:
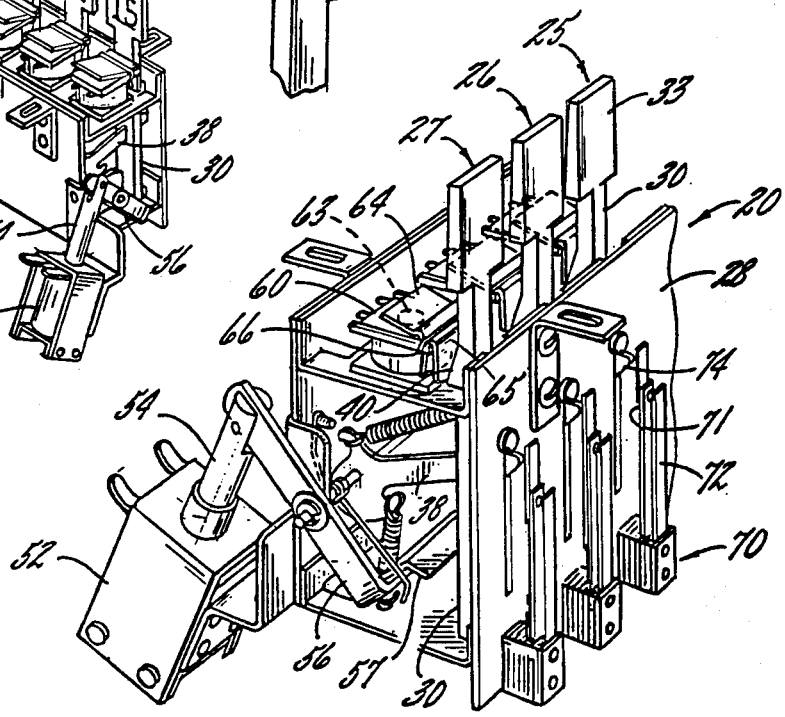
FIG. 3 is a fragmentary perspective showing the back view of the assembly of FIG. 2.

Turning to the details of the assembly 20, it includes a plurality of subassemblies 21–27 mounted side by side in a frame 28, with the targets of the assemblies being all alined with an opening 29. Taking subassembly 21 (FIG. 4) as typical, and as viewed along line 4—4 in FIG. 2, it includes a vertically arranged slider 30 which may, for example, be in the form of a molded flat strip of plastic arranged edge to edge with the other sliders in the series. The slider is vertically slidable in way surfaces 31, 32 at the top and bottom walls of the frame 28. The slider 30 has a target 33 at its upper end, the slider being vertically movable on the ways between an upwardly projecting play position, illustrated in FIG. 4, and a dropped position, which is illustrated in FIG. 5. For biasing the slider to its dropped position a first spring 35 is provided which engages an arm 36 on an actuating lever pivoted at 37 and having a second arm 38 which penetrates an opening 39 in the slider.

Integral with the slider is a forwardly facing latch 40 cooperating with a keeper 41, the keeper being integral with the way surface 31 previously mentioned. To permit backward movement of the slider and thus disengagement of the latch when the slider is in play position, rearward clearance is provided in the regions 31′, 32′ rearwardly of the way surfaces. For the purpose of biasing the slider forwardly, a spring 45 is used which engages a hook 46 on the slider and a hook 47 on the lever.

In order to reset the slider 30 of the subassembly 21 and, simultaneously all of the other sliders in the series, to latched position, solenoids 51, 52 are provided having plungers 53, 54 connected respectively to levers 55, 56 having a cross bar 57. When the solenoids are actuated, the cross bar 57 is swung upwardly with a positive force thereby raising all of the arms 38 in the respective subassemblies to the upraised position illustrated in FIG. 4 in which each latch 40 engages its keeper 41, the slider being laterally urged into latching position by the force of the associated spring 45.

During the course of play, and as illustrated in FIG. 5, when one of the targets, for example that shown at 33, is hit by the ball, the target, and upper end of the slider, are impacted rearwardly, overcoming the biasing force of spring 45 and disengaging the latch 40 from keeper 41. With the latch thus tripped, arm 38 of the lever, under the biasing force of spring 35, promptly retracts the slider from its projecting play position to the recessed position illustrated in FIG. 5. The clockwise rocking movement of the lever simultaneously releases the lateral biasing force upon the slider imposed by spring 45 to reduce friction at the way surfaces.

In accordance with one of the important features of the present invention each of the sliders has an associated electromagnetic including a movable armature adjacent the latch coupled to the upper end of the slider to move the same backwardly to release the latch, and thereby artificially dropping the associated target, when the electromagnet is energized. Thus, referring to FIG. 6, the electromagnet associated 60 with the slider 30, fed by terminal 61, 62, has a vertically extending pole 63 and an armature which is of "L" or dog-leg shape having a first, or horizontal, arm 64 and a second, or vertical, arm 65 centrally pivoted at 66. The electromagnet is centered with respect to the slider 30 so that the lower tip of the arm 65 of the armature, when energized, applies a lateral unseating force to the latch 40. The effect of a typical electromagnetic actuation is illustrated in FIG. 6, the armature moving from the dotted position to the full line position causing the latch 40 to be shoved clear of the keeper 41 against the force of bias of the spring 45. As a result the slider is free to be drawn down to its recessed position by the force transmitted from spring 35.

The terminals 61, 62 of the electromagnet are, in accordance with one of the features of the invention, energized by a remote ball-operated device on the play field, for example, by a rollover button 67 having a switch 68 and with an interposed source of voltage 69; thus, the target may be dropped either as a result of direct striking by the ball or as a result of a contact made by the ball at a remote position on the play field.

However, in accordance with the invention, the preferred means for artificially dropping a target is to provide a second target assembly 20*a*, which may be a substantial duplicate of the assembly 20, and which has switches associated with the individual sliders with each switch being connected to the electromagnet associated with a corresponding slider in the opposite assembly. Taking the switch 70 associated with the slider 30 as typical (FIGS. 4 and 5), it includes leaf spring contacts 71, 72, the leaf 71 having an associated actuating leaf 73 which is engaged by the tip 74 of the lever 38. Thus when the slide 30 drops, accompanied by downward rotation of the lever, wiping of the tip of the lever into the dotted position illustrated in FIG. 5 causes the contacts 71, 72 to close momentarily. Such momentary contact, and the resultant momentary energization of the associated electromagnet, suffices to release the latch of the associated slider.

Figure 7:
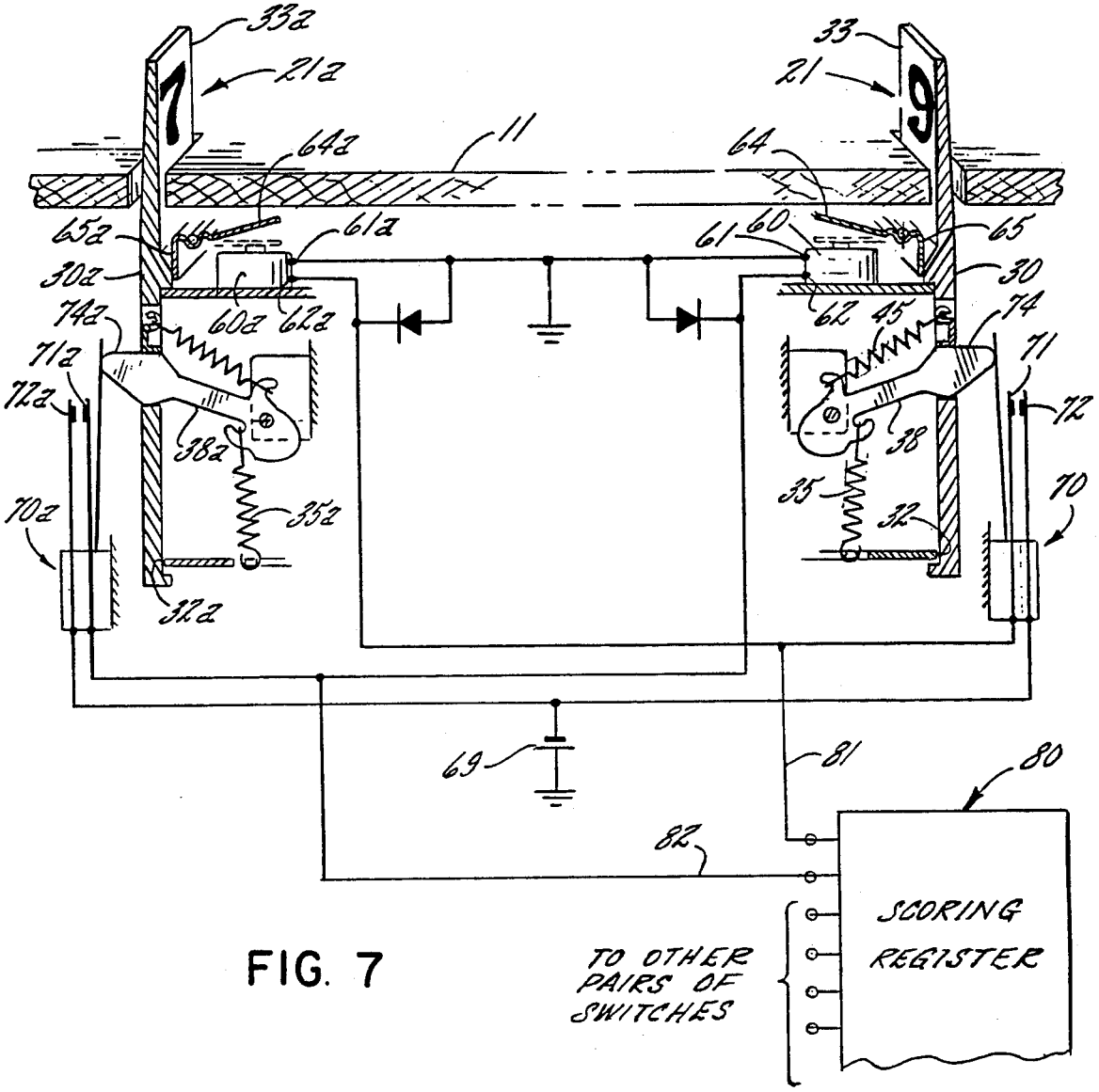
FIG. 7 shows a typical circuit which may be employed between corresponding sliders of two separate drop target assemblies to bring about a duplicate drop upon the striking of a single target.

The manner in which corresponding sliders in the two target assemblies are electrically connected together is clearly shown in FIG. 7, where the elements making up the subassembly 21*a* of the associated slider are set forth in mirror image and identified with the same reference numerals with the addition of subscript a. Here it will be seen that the contacts of switch 70 are connected to control solenoid 60*a* while the contacts of switch 70*a*, in the opposite unit, are connected to energize the solenoid 60, a suitable source of voltage 69 being interposed in series with the circuit. It will be understood that, in a practical case, each slider is connected to a conventional scoring register, diagrammatically illustrated at 80, two of the input lines, 81, 82 being shown.

Striking of the target 33 by a ball 12, illustrated in FIG. 5, has therefore a total of four effects: Dropping of the target, by reason of closure of the switch 70, via line 81, energizes the scoring register and, at the same time, energizes the solenoid 60*a* to drop target 33*a*. The resulting closure of the switch 70*a*, via line 82, further energizes the scoring register. Thus the drop targets are taken down at twice the regular rate and scoring is doubled. The same effect is achieved in the event that the target 33*a* is struck by the ball. The double dropping and double scoring is characteristic, to equal degree, of all of the subassemblies 21–27 and their counterparts 21*a*–27*a*.

When a game has been completed, and a new game initiated, the reset solenoids 51, 52 are energized simultaneously, by means not shown, thereby restoring all of the targets to their upwardly projecting play positions.

While the invention has been described in terms of interconnection of positionally corresponding target sliders, it will be understood that the term "corresponding" refers to the sliders and associated elements which are electrically connected without limitation to particular physical positions.

What I claim is:

1. In a pinball game machine, the combination comprising:

(a) a playfield for supporting a rolling ball;

(b) a drop target assembly, including a ball-engageable target, supported by the playfield and having means for advancing the target from a ball-engageable play position above the playfield to a non-ball-engageable dropped position below the playfield when the ball engages the target, said assembly including a latch mechanism for latching the target in the play position; and (c) means, including a ball actuable switch assembly disposed on the playfield, for unlatching said latch mechanism and advancing the target to the dropped position independently of the ball engaging the target.

2. The combination according to claim 1 wherein said switch assembly is disposed on the playfield at a position remote from said drop target assembly.

3. The combination according to claim 1 wherein said advancing means includes means for enabling said drop target assembly to advance the target to the dropped position when the ball engages said switch assembly.

4. The combination according to claim 1 wherein said advancing means includes an electromagnet responsive to the ball engaging said switch assembly for enabling said drop target assembly to advance the target to the dropped position.

5. The combination according to claim 1 and including a second drop target assembly substantially the same as said first claimed drop target assembly, and wherein said switch assembly is the second drop target assembly, and wherein the ball engaging either the targets of the first or second drop target assemblies effects the advancing of both said targets to their respective dropped positions.

6. The combination according to claim 5 and including means for registering the dropping of each said target to the dropped position.

7. In a pinball game machine, the combination comprising:

(a) a playfield for supporting a rolling ball;

(b) first and second drop target assemblies, including respectively first and second arrays of ball-engageable targets, supported by the playfield and respectively having means for advancing each of the targets from a ball-engageable play position above the playfield to a non-ball-engageable dropped position below the playfield when the ball engages the particular target, the drop target assembly including means for latching the targets in the play position; and (c) means for unlatching the latching means and advancing one of the first array of targets to its dropped position when the ball engages one of the second array of targets and independently of the ball engaging the first array of targets.

8. A drop target assembly for pinball game machines comprising:

(a) a frame assembly;

(b) an elongated slider which defines a target at one end and which is slidable in said frame assembly (i) between a play position in which the target is exposed for engagement with a pinball and (ii) a dropped position in which the target is not exposed for engagement with a ball, the slider having a latching mechanism for latching the target in the play position;

(c) means for unlatching the latch mechanism and advancing the slider to the dropped position in response to the ball engaging the target; and (d) a switch circuit for activating the advancing means to advance the slider to the dropped position independently of the ball engaging said target.

9. The assembly according to claim 8 wherein the switch is associated with a second target disposed remote from said first named target.

10. The assembly according to claim 8 wherein said switch includes a second said frame assembly, a second said slider and a second said advancing means, thereby defining a second drop target assembly.

11. The assembly according to claim 10 wherein said sliders are each a respective one of an array of said sliders, thereby to define first and second arrays of targets, whereby the ball hitting a target of one array effects dropping of that target and a corresponding target in the other array to the respective dropped positions.

12. In a pinball game machine, the combination comprising:

(a) a playfield for supporting a rolling ball;

(b) a drop target assembly, including at least a first ball-engageable target, supported by the playfield and having means for advancing the first target from a ball-engageable play position above the playfield to a non-ball-engageable dropped position below the playfield when the ball engages the target, said assembly further having means for latching the first target in the play position;

(c) first target independent means operatively coupled to the drop target assembly for unlatching the latching means and advancing the first target to the dropped position independently of the ball engaging the first target and in response to an energizing signal; and (d) means for providing the energizing signal to the first target independent means.

13. The combination according to claim 12 wherein said first target independent means includes an electromagnet.

14. The combination according to claim 13 wherein the drop target assembly includes a slider which defines said first target and wherein said first target independent means further includes a member operatively coupled to the electromagnet for engaging said slider to enable the dropping of said first target.

15. A drop target assembly for pinball game machines comprising (a) a frame assembly;

(b) an elongated slider having a first target at one end and which is slidable in said frame assembly (i) between a play position in which the first target is exposed for engagement with a pinball and (ii) a dropped position in which the first target is not exposed for engagement with a ball;

(c) a latch mechanism for latching the slider in the play position;

(d) means for advancing the slider to the dropped position in response to the ball engaging the first target;

(e) first target independent means for unlatching the latch mechanism and advancing the slider to the dropped position independently of the ball engaging said first target and in response to an energizing signal; and (f) means for providing the energizing signal to the first target independent means.

16. The assembly according to claim 15 wherein the first target independent means is coupled to the advancing means for selectively activating the advancing means to drop the slider.

17. The assembly according to claim 15 wherein the first target independent means includes an electromagnet operatively associated with said slider.

18. The assembly according to claim 17 wherein the first target independent means further includes a moveable member operatively coupled to the electromagnet for engaging the slider to selectively drop said first target.

19. A drop target assembly for pinball game machines comprising:

(a) a frame assembly;

(b) an elongated slider having a target at one end and which is slidable in said frame assembly (i) between a play position in which the target is exposed for engagement with a pinball and (ii) a dropped position in which the target is not exposed for engagement with a ball;

(c) a latch mechanism for latching the slider in the play position;

(d) means for advancing the slider to the dropped position in response to the ball engaging the target;

(e) electromagnetic means coupled to said frame assembly for unlatching the latch mechanism and enabling the slider to advance to the dropped position independently of the ball engaging said target and in response to an energizing signal; and (f) means for providing the energizing signal to the electromagnetic means.

20. A drop target assembly for pinball-game machines comprising:

(a) A frame assembly;

(b) an elongated slider having a target at one end and which is slidable in said frame assembly (i) between a play position in which the target is exposed for engagement with a pinball and (ii) a dropped position in which the target is not exposed for engagement with a ball;

(c) a latch assembly for latching the slider in the play position and for advancing the slider to the dropped position in response to the ball engaging the target to thereby unlatch said slider;

(d) electromagnetic means coupled to said frame assembly for selectively unlatching the slider to allow it to advance to the dropped position independently of the ball engaging said target and in response to an energizing signal; and (e) means for providing the energizing signal to the electromagnetic means.

21. In a pinball game machine, the combination comprising:

(a) a playfield for supporting a rolling ball;

(b) a drop target assembly, including at least one ball-engageable target, supported by the playfield and having means for advancing a first target from a ball-engageable play position above the playfield to a non-ball-engageable dropped position below the playfield when the ball engages the target, the assembly further having means for latching the one target in the play position;

(c) first target independent means coupled to the drop target assembly for unlatching the latching means and advancing the first target to the dropped position independently of the ball engaging the first target; and (d) a ball responsive device operatively coupled to the first target independent means for selectively actuating said first target independent means to advance the first target.

* * * * *